US006409306B1

(12) United States Patent
Shiida

(10) Patent No.: US 6,409,306 B1
(45) Date of Patent: Jun. 25, 2002

(54) INK-JET PRINTER

(75) Inventor: Sakae Shiida, Numazu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/484,916

(22) Filed: Jan. 18, 2000

(30) Foreign Application Priority Data

Jan. 20, 1999 (JP) ..... 11-011682

(51) Int. Cl.[7] ..... B41J 2/55
(52) U.S. Cl. ..... 347/42
(58) Field of Search ..... 347/42, 197, 222, 347/238, 49; 400/120.16, 692

(56) References Cited

U.S. PATENT DOCUMENTS 5,266,966 A * 11/1993 Fushimi et al. ..... 347/220
5,608,433 A * 3/1997 Quate ..... 347/40
6,286,934 B1 * 9/2001 Sakanobe et al. ..... 347/49

FOREIGN PATENT DOCUMENTS

JP 10-138520 5/1998 ..... B41J/2/21

* cited by examiner

*Primary Examiner*—John Barlow
*Assistant Examiner*—Julian D. Huffman
(74) *Attorney, Agent, or Firm*—Frishauf, Holtz, Goodman & Chick, P.C.

(57) ABSTRACT

An ink jet printer includes a rotary drum, a head unit, and a head supporting mechanism for supporting the head unit detachably attached thereto. The head supporting mechanism includes first and second supporting frames, first and second lower supporting members, an urging member for urging the first end of the head unit put on the first supporting member toward the second supporting frame, and a position adjusting member for sliding the second end of the head unit put on the second supporting member toward the first supporting frame against an urging force from the urging member, wherein the position adjusting member includes a screw inserted in a screw hole formed through the first supporting frame and the first supporting section.

7 Claims, 3 Drawing Sheets

INK-JET PRINTER

BACKGROUND OF THE INVENTION

The present invention relates to an ink-jet printer for printing an image on a print medium held on a rotary drum with ink ejected from a print head, and more particularly to an ink-jet printer in which a print head is fixed between a pair of head supporting frames which face each other in an axial direction of the rotary drum.

For example, Jpn. Pat. Appln. KOKAI Publication No. 10-138520 discloses a drum rotation ink-jet printer which can make a large number of prints in a short period of time. The drum rotation ink-jet printer comprises a rotary drum which rotates in one direction and a head unit for printing an image on a paper sheet wound around the rotary drum and rotating along with the drum. The head unit has a plurality of ink-jet nozzles arranged in the axial direction of the Rotary drum to extend across the paper sheet, and ejects ink from the ink-jet nozzles onto the paper sheet, which is moved relative to the head unit by rotation of the rotary drum. Since this structure does not require remarkable movement of the head unit as in the conventional serial ink-jet printer, printing can be performed at a high speed. Further, since ink is supplied to the head unit from an ink tank of a large capacity located apart from the head unit, the number of sheets printed for each supplementation of ink can be increased.

The ink-jet printer of this type requires periodic maintenance to prevent clogging by means of ejecting a predetermined amount of ink through all ink-jet nozzles. In the maintenance, the head unit is moved up by an elevator mechanism to a maintenance position from a print position which is close to the rotary drum. Further, a washing board is inserted between the head unit and the rotary drum to collect the ink ejected from the ink-jet nozzles and to discharge it as waste ink.

The elevator mechanism has first and second head supporting frames which face each other in the axial direction of the rotary drum in order to support both ends of the head unit. The head unit is fixed to the first and second head supporting frames by two screws which are screwed from both sides.

However, when the head unit is fixed by screws from both sides, a great deal of time and labor is required for attaching or detaching the head unit to or from the ink-jet printer in the case of assembly, inspection, repair, or replacement of printer components. Further, not only the aforementioned screwing structure is required, but also a workspace must be reserved in the printer to fasten the screws. The workspace is located outside the first and second head supporting frames in the axial direction of the rotary drum. This inevitably increases the printer width, which considerably depends on the length of the head unit extending in the axial direction of the rotary drum and has less degree of freedom as compared to the depth. Consequently, it is difficult to reduce the size and weight of the printers to realize a widespread use thereof.

BRIEF SUMMARY OF THE INVENTION

An object of the present invention is to provide an ink-jet printer in which quick and easy attachment or detachment of a head unit can be achieved without requiring an increase in width of the printer.

According to the present invention, there is provided an ink-jet printer which comprises a medium carrier for carrying a print medium; a head unit, having a plurality of ink-jet nozzles arranged in a width direction of the medium carrier, for ejecting ink toward the print medium carried by the rotary drum from the ink-jet nozzles to print an image on the print medium; and a head supporting mechanism for supporting the head unit detachably attached thereto; wherein the supporting mechanism includes first and second supporting frames facing each other in the width direction of the medium carrier; first and second supporting sections, respectively protruded from the first and the second supporting frames, for receiving first and second ends of the head unit put thereon and supporting the head unit so as to be slidable in the width direction of the rotary drum; an urging member for urging the first end of the head unit received by the first supporting section toward the second supporting frame while allowing vertical movement of the first end to and from the first supporting section; and a position adjusting member for sliding the second end of the head unit put on the second supporting section toward the first supporting frame against urging force from the urging member.

In this ink-jet printer, the head unit can be quickly and easily attached to and detached from the head supporting mechanism. At this time, it is only necessary for the operator to hold the head unit by hand and move it vertically. Further, since the head unit is slid by the urging force from the urging member after attachment to the head supporting mechanism, the position of the head unit can be automatically determined in the width direction of the medium carrier.

Moreover, this position is also adjustable by the position adjusting member. With the structure described above, the width of the ink-jet printer is prevented from increasing, while the size, weight and cost of the ink-jet printer can be reduced. Since the workspace is located only on one side of the ink-jet printer, positional adjustment of the head unit can be performed quickly and easily without being considerably influenced by the installation space of the printer, as compared with the case where both sides of the printer are occupied.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet printer according to an embodiment of the present invention will be described with reference to the accompanying drawings.

Figure 1:
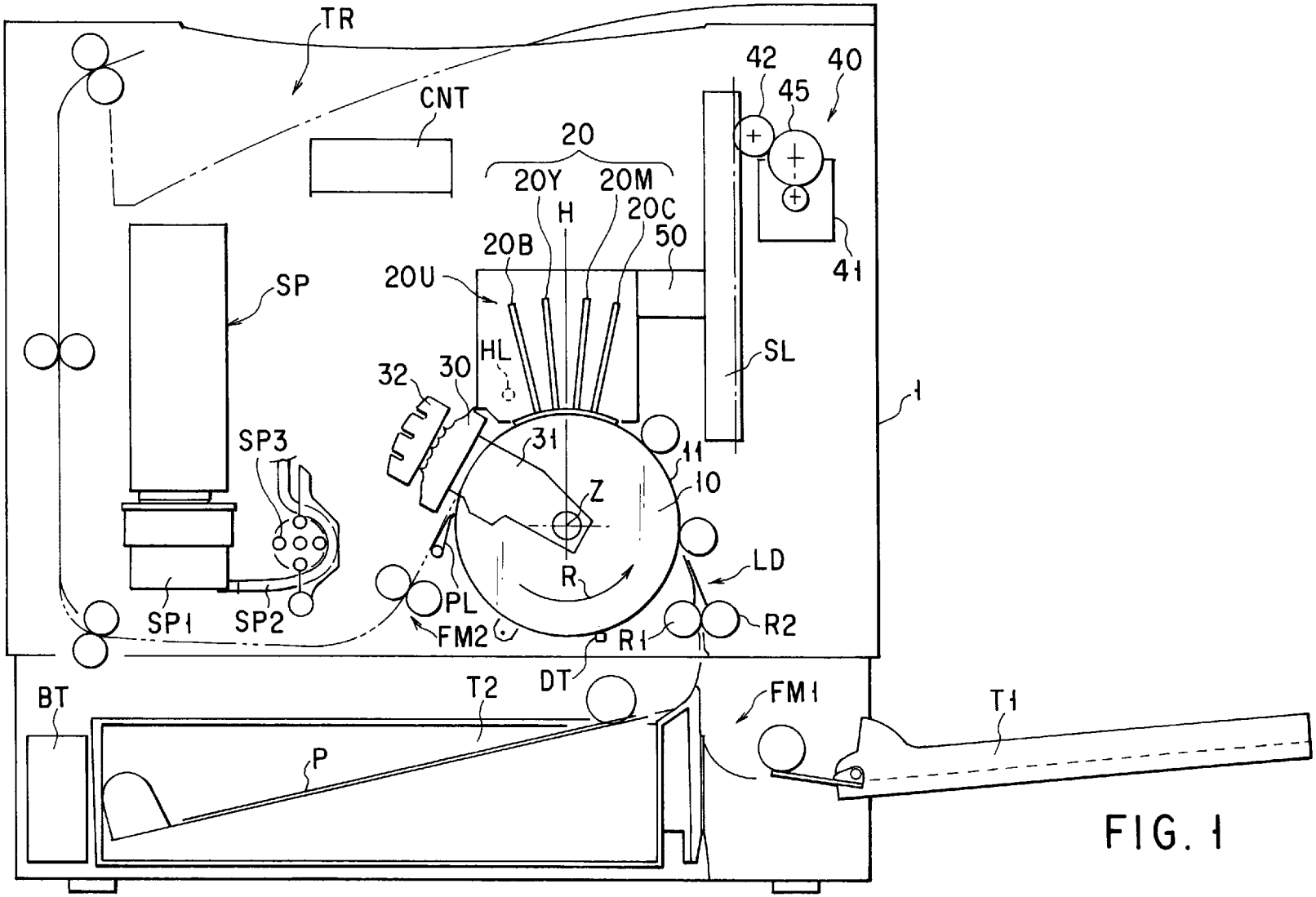
FIG. 1 is a schematic diagram showing an internal structure of an ink-jet printer according to an embodiment of the present invention.

FIG. 1 shows an internal structure of the ink-jet printer. The ink-jet printer is used to print a multicolor image on a paper sheet P cut as a print medium. The paper sheet P may be a plain paper sheet, an OHP sheet or the like.

The ink-jet printer includes a rotary drum 10 which rotates at a constant circumferential speed to carry a paper sheet P held thereon, a head unit 20U for printing a multicolor image on the paper sheet P rotating along with the rotary drum 10, a manual-feed tray T1 for receiving a paper sheet P to be inserted one by one, a sheet cassette T2 for containing a stack of paper sheets P, a sheet feed-in mechanism FM1 for feeding the paper sheets P to the rotary drum 10 from the sheet cassette T2 and the manual-feed tray T1, a sheet feed-out mechanism FM2 for feeding out the paper sheet P printed at the rotary drum 10, and a control unit CNT for controlling the overall operation of the ink-jet printer. As shown in FIG. 1, the rotary drum 10 is located in the central portion within a housing 1. The manual-feed tray T1 projects externally from a front surface of the housing 1 at a position located below the rotary drum 10. The sheet cassette T2 is located under the rotary drum 10. The sheet feed-in mechanism FM1 is located between the manual-feed tray T1 and the sheet cassette T2. The head unit 20U is located above the rotary drum 10. The sheet feed-out mechanism FM2 is located behind the rotary drum 10.

The rotary drum 10 is supported so as to be rotatable about the axis, and holds the paper sheet P wound around a peripheral surface 11 in accordance with its rotation. The rotational position of the rotary drum 10 is detected by a rotational position detector DT provided near the peripheral surface of the rotary drum 10. The head unit 20U includes a print head 20 having four nozzle units 20C, 20M, 20Y and 20B, arranged in series along the peripheral surface 11 of the rotary drum 10 from the upstream side to the downstream side, so as to perform printing on the paper sheet P with inks of cyan, magenta, yellow and black. The nozzle units 20C, 20M, 20Y and 20B receive inks of the corresponding colors from four ink supply units SP remote therefrom. The ink supply units SP include ink tanks SP1 for respectively storing cyan, magenta, yellow and black inks, four supply tubes SP2 connecting the ink tanks SP1 with the nozzle units 20C, 20M, 20Y and 20B, and four pressure pumps SP3 for pressurizing the four supply tubes SP2 such that the inks of the respective colors flow. Each of the nozzle units 20C, 20M, 20Y and 20B has a plurality of (e.g., 2000) ink-jet nozzles which are arranged along the axial direction of the rotary drum 10 at pitch of, for example, 1/75 inch to eject the ink of the corresponding color to the paper sheet P. These ink-jet nozzles are arranged to have a span corresponding to 210 mm, i.e., the width of the paper sheet P of A4 size. The sheet feed-in mechanism FM1 has a sheet loader LD for loading the paper sheet P to the rotary drum 10 such that the width direction of the paper sheet P coincides with the axial direction of the rotary drum 10, and feeds the paper sheet P taken out from either the manual-feed tray T1 or the sheet cassette T2. The sheet loader LD is controlled to feed the paper sheet P toward the rotary drum 10 when the position detector DT detects that the rotary drum 10 has arrived at a predetermined rotational position. The print head 20 prints a multicolor image on the paper sheet P as the rotary drum 10 rotates.

After printing, the paper sheet P is unloaded from the peripheral surface 11 of the rotary drum 10 by a sheet unloader PL, and fed to a discharge tray TR by the sheet feed-out mechanism FM2. The sheet unloader PL is a separating pawl which is brought into contact with the rotary drum 10 when the paper sheet P is to be unloaded.

The head unit 20U can be slightly and reciprocally shifted in a main scanning direction X parallel to the axial direction of the rotary drum 10. The rotary drum 10 holds the paper sheet P wound around the peripheral surface 11 and rotates to carry the paper sheet P in a sub-scanning direction Y perpendicular to the main scanning direction X, with the paper sheet P opposing the nozzle units 20C, 20M, 20Y and 20B. To achieve a multicolor print of, for example, 20 PPM, the rotary drum 10 is maintained at a constant rotation rate of 120 rpm, and makes one rotation in every 0.5 second. In the print operation, the head unit 20U is shifted in the main scanning direction X at a constant rate of ¼ nozzle pitch PT every time the rotary drum makes one rotation, so that it moves by a distance equal to the nozzle pitch PT during four rotations. With this structure, printing of the entire surface of the paper sheet P is completed in 2 seconds (0.5 second×4) required to make four rotations of the rotary drum 10. In consideration of the time required for two revolutions of the rotary drum (one for winding the paper sheet P thereon before printing and one for separating it after printing), a multicolor image can be printed on the paper sheet P of A4 size at a high speed of 3 (=2+1) seconds per sheet. Thus, printing can be consecutively performed on 20 paper sheets every minute.

The sheet loader LD includes at least a pair of feed rollers R1 and R2 extending along the axial direction of the rotary drum 10 so as to feed the paper sheet P supplied from the feeder T1 or T2 to the rotary drum 10 at predetermined timing. The feed rate of the paper sheet P is set to a value corresponding to the circumferential speed of the rotary drum 10. Since the diameter of the rotary drum 10 is 130 mm, the circumferential speed of 816 mm/sec can be obtained. The peripheral surface 11 of the rotary drum is about 220 mm wide in the axial direction and about 408 mm long in the rotational direction. Therefore, the rotary drum 10 can fully hold the paper sheet P of A4 size having a length of 297 mm and a width of 210 mm.

Figure 2:
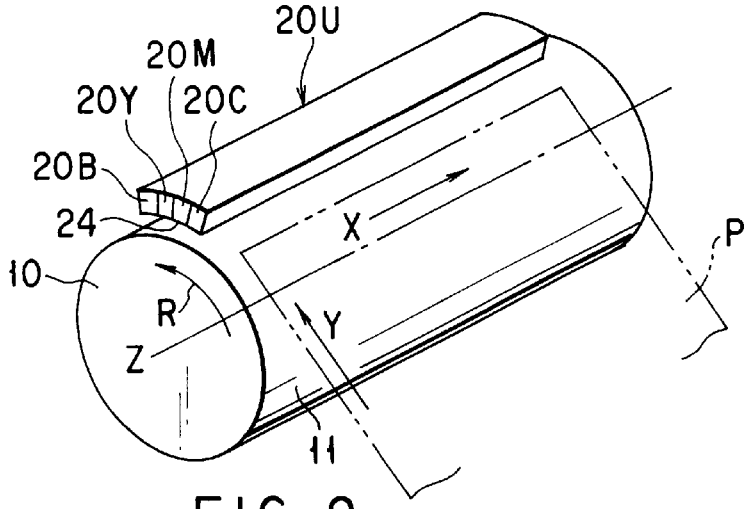
FIG. 2 is a perspective view showing the positional relationship between a head unit and a rotary drum shown in FIG. 1.

In the ink-jet printer described above, the rotary drum 10 and the head unit 20U are arranged as shown in FIG. 2. A washing board 30 shown in FIG. 1 can be inserted between the head unit 20U and the rotary drum 10. The washing board 30 is set to face an end surface 24 of the head unit 20U such that the paper particles adhered to the end surface 24 is removed with ink ejected from the ink-jet nozzles of the nozzle units 20C, 20M, 20Y and 20B, and collects the ejected ink along with the removed paper particles so as to discharge them to a waste ink bottle BT.

The height of the head unit 20U can be automatically adjusted by an elevator mechanism 40. In this adjustment, the head unit 20U is set to the lowermost position shown in FIG. 3A at a printing time, the uppermost position shown in FIGS. 3B and 3C at a non-printing time, and a cleaning position shown in FIG. 3D at a maintenance time. In the lowermost position, the gap between the ink-jet nozzles and the rotary drum 10 is set to about 1 mm.

The elevator mechanism 40 includes a head supporting mechanism 50 connected to the head unit 20U, a rack slider SL slidable in a height direction H perpendicular to the axis Z of the rotary drum 10 together with the head unit 20U and the head supporting mechanism 50, and an elevator driving unit for driving the rack slider SL. The elevator driving unit includes a motor 41, a pinion 42, a worm gear 45, etc. Further, the elevator driving unit is constructed so as to make the head supporting mechanism 50 capable of slightly shifting relative to the rack slider SL along the axis Z of the rotary drum 10.

The washing board 30 is rotatable about the axis Z of the rotary drum 10 by means of a rotational position determining unit 31, so that it can be selectively inserted into or retreated from a space between the head unit 20U and the peripheral surface 11 of the rotary drum 10. A head cleaner 32 is attached to the washing board 30 and is movable in the axial direction of the rotary drum 10 to rub away ink remaining on the end surfaces of the ink-jet nozzles.

Figure 3A:
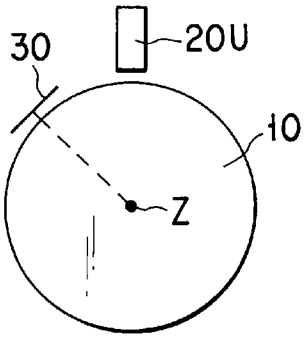
FIGS. 3A to 3D are diagrams for explaining motions of the head unit and a washing board shown in FIG. 1.
Figure 3C:
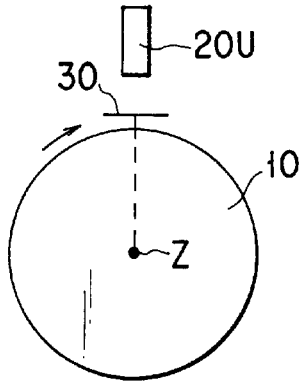
Figure 3B:
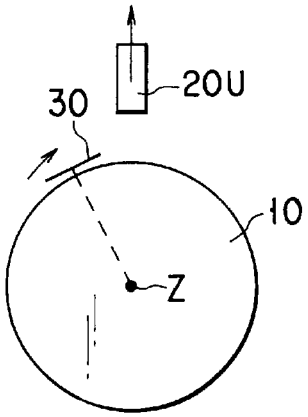
Figure 3D:
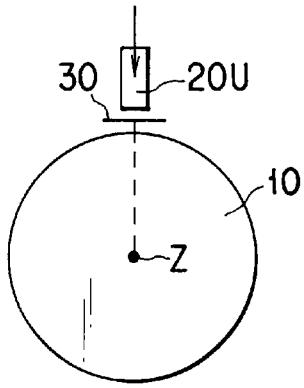

The rotational position determining unit 31 includes a supporting frame, a power transmitting gear mechanism, a drive motor, a position detecting sensor, etc., and arranged such that the position of the washing board 30 can be selectively and automatically determined to the retreat position tilted to the left side at the angle of 45° as shown in FIG. 3A or a cleaning position as shown in FIGS. 3C and 3D.

In the ink-jet printer, the control unit CNT performs maintenance control during a non-printing time (for example, periodically). By this control, the elevator mechanism 40 elevates the head unit 20U from the position shown in FIG. 3A to the uppermost position shown in FIG. 3B. Thereafter or simultaneously, the rotational position determining unit 31 rotates the washing board 30 to the position shown in FIG. 3C. In this state, the control unit CNT controls the motion of the elevator mechanism 40 to be reversed and stop when the end surfaces of the ink-jet nozzles and the washing board 30 form a predetermined gap.

In this state, inks are supplied through the supply tubes SP2 to the print head 20 by the pressure pumps SP3, and ejected to the washing board 30 from all the nozzles. This operation serves to prevent clogging of the nozzles and also to vent air from the nozzles. The ejected ink is struck onto the washing board 30 and brought into contact with the end surfaces of the ink-jet nozzles. Then, removing the paper particles adhered to the end surfaces, it returns to the washing board 30. The ink is discharged to the waste ink bottle BT along with the paper particles.

Figure 4:
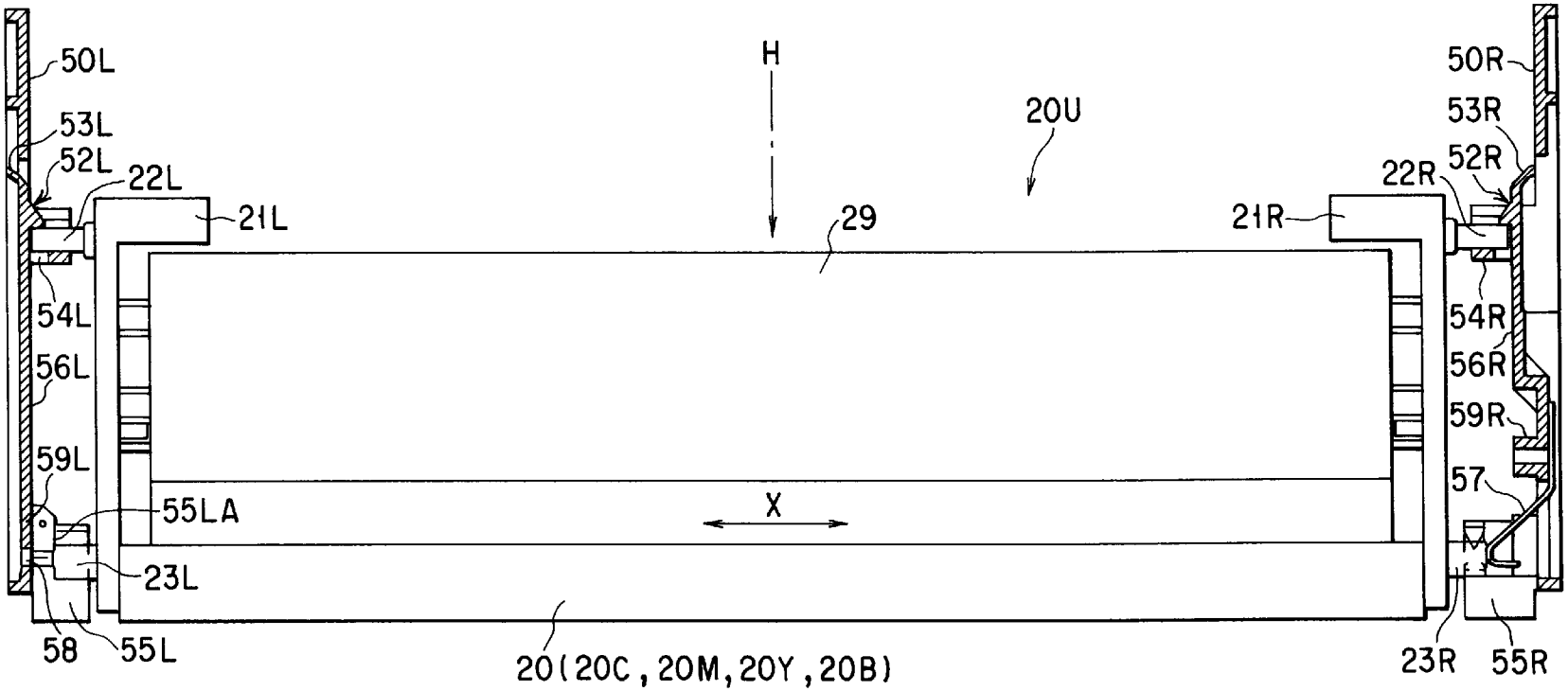
FIG. 4 is a diagram showing a structure for supporting the head unit shown in FIG. 1.

FIG. 4 shows a structure for supporting the head unit 20U. The head unit 20U includes, in addition to the print head 20 described above, a heat sink 29 mounted on the print head 20 to absorb heat generated by the print head 20, and brackets 21L and 21R arranged on both sides of the print head 20 to support the print head 20 and the heat sink 29 therebetween. The bracket 21L has cylindrical upper and lower engaging members 22L and 23L perpendicularly projecting from the side opposite to the print head 20. The bracket 21R has cylindrical upper and lower engaging members 22R and 23R perpendicularly projecting from the side opposite to the print head 20.

To support both ends of the head unit 20U detachably attached, the heat supporting mechanism 50 includes a pair of parallel supporting frames 50L and 50R which face each other in the axial direction of the rotary drum 10, groove-shaped upper and lower supporting members 54L and 55L projecting from the supporting frame 50L toward the supporting frame 50R, and groove-shaped upper and lower supporting members 54R and 55R projecting from the supporting frame 50R toward the supporting frame 50L. At the time of attaching the head unit 20U, the upper supporting members 54L and 54R support the upper engaging members 22L and 22R of the brackets 21L and 21R put thereon such that they can be slid in the main scanning direction X parallel to the axis Z of the rotary drum 10. The lower supporting members 55L and 55R support the lower engaging members 23L and 23R of the brackets 21L and 21R such that they can be slid in the main scanning direction X.

In order to attach the head unit 20U to the head supporting mechanism 50 by moving it vertically with respect the top of the peripheral surface 11 of the rotary drum 10, the upper engaging members 22L and 22R are located at positions laterally or horizontally displaced with respect to those of the lower engaging members 23L and 23R. To cope with the displacement, the upper supporting members 54L and 54R are located at positions also laterally or horizontally displaced with respect to those of the lower supporting members 55L and 55R. The upper supporting member 54L and the supporting frame 50L are integrally molded as one piece from a plastic material of high elasticity. Likewise, the upper supporting member 54R and the supporting frame 50R are integrally molded as one piece from the plastic material of high elasticity. The lower supporting members 55L and 55R are made of a metallic material of high heat conductivity, such as an alloy of aluminum, so that the print head 20 can be cooled quickly and the mechanical strength thereof can be improved.

The head supporting mechanism 50 further includes an urging member 57 having a leaf spring or the like attached to the supporting frame 50R and a position adjusting member 58 having a screw or the like attached to the supporting frame 50L. The supporting frame 50L and the lower supporting member 55L have screw holes through which the screw of the position adjusting member 58 is inserted. The housing 1 has a small hole HL at the position corresponding to the screw holes of the supporting frame 50L and the lower supporting member 55L. The urging member 57 urges the lower engaging member 23R put on the lower supporting member 55R toward the supporting frame 50L. The position adjusting member 58 slides the lower engaging member 23L put on the lower supporting member 55L toward the supporting frame 50R against the urging force of the urging member 57. The lower supporting member 55L has a stopper surface 55LA which exposes the screw of the position adjusting member 58 and is bought into contact with the lower engaging member 23L urged by the leaf spring of the urging member 57 to determine the position of the head unit 20U before the screw is screwed into the screw hole HL. The leaf spring of the urging member 57 has a structure such that it can be moved in a direction opposite to the direction in which the urging force is exerted, when the head unit 20U is attached to the head supporting member 50 by hand. With this structure, the lower engaging members 23L and 23R can be completely brought into contact with the bottom surfaces of the lower supporting members 55L and 55R. Therefore, the position of the head unit 20U can be adjusted in the main scanning direction X by rotating the screw of the position adjusting member 58 after attachment of the head unit 20U to protrude the top end of the screw through the stopper surface 55LA of the lower supporting member 55L. More specifically, the head unit 20U is moved toward the supporting frame 50R by increasing the length of protruded portion of the screw and toward the supporting frame 50L by decreasing the length thereof. Thus, the rotation of the screw allows fine adjustment of the print position in the main scanning direction X.

The head supporting mechanism 50 further includes rise preventing members 52L and 52R molded integral with the supporting frames 50L and 50R. The rise preventing members 52L and 52R include, for example, levers 56L and 56R which utilize elastic force to prevent the upper engaging members 22L and 22R put on the upper supporting members 54L and 54R from rising. The levers 56L and 56R can be elastically deformed about proximal end portions 59L and 59R formed integral with the supporting frames 50L and 50R, using them as fulcrums. They have hooks opposed each other at their distal end portions on the sides opposite to the proximal end portions 59L and 59R. The levers 56L and 56R are deformed for causing the upper engaging members 22L and 22R to pass through the hooks when the head unit 20U is attached on the head supporting member 50 by hand. The levers 56L and 56R are thereafter elastically restored to engage the hooks with the upper engaging members 22L and 22R. As a result, the levers 56L and 56R prevent the upper engaging members 22L and 22R from rising up from the bottom surfaces of the upper supporting members 54L and 54R. The top ends of the levers 56L and 56R constitute release pawls 53L and 53R to enable a manual operation for releasing the hooks from the upper engaging members 22L and 22R.

In the case of assembly, inspection, repair, or replacement of components of the ink-jet printer, the operator holds the head unit 20U with hands such that the end surfaces of the ink-jet nozzles face the rotary drum 10 and moves it vertically to attach it to the head supporting mechanism 50. At this time, the upper supporting members 54L and 54R and the lower supporting members 55L and 55R of the head supporting mechanism 50 respectively support the upper engaging members 22L and 22R and the lower engaging members 23L and 23R provided on both sides of the head unit 20U. In this state, when the hands are released from the head unit 20U, the head unit 20U is urged toward the supporting frame 50L by the urging member 57, with the result that the lower engaging member 23L is held in contact with the stopper surface 55LA. At this time, the upper engaging members 22L and 22R of the head unit 20U are engaged with the hooks of the levers 56L and 56R. In general, the head unit 20U can be used in this state. If positional adjustment of the head unit 20U is required, the screw of the position adjusting member 58 is put on the tip of a thin driver, and screwed through the small hole HL of the housing 1 into the screw holes of the supporting frame 50L and the lower supporting member 55L. The driver is further rotated so that the screw is protruded from the stopper surface 55LA, thereby moving the head unit 20U in the main scanning direction X parallel to the axis Z of the rotary drum 10.

When the head unit 20U is to be detached from the head supporting mechanism 50, the operator holds the head unit 20U and operates the release pawls 53L and 53R outwardly. As a result, the hooks of the levers 56L and 56R release the upper engaging members 22L and 22R. Accordingly, the operator can lift up the head unit 20U.

In the embodiment described above, it is only necessary for the operator to move the head unit 20U vertically downward by hand to attach it onto the head supporting mechanism 50. Further, it is only necessary to operate the release pawls 53L and 53R and lift the head unit 20U up to detach it from the head supporting mechanism 50. Thus, the head unit 20U can be attached and detached easily and quickly.

After attachment, the head unit 20U is slid by the urging force of the urging member 57 to the position defined by the stopper surface 55LA or the screw of the position adjusting member 58. Therefore, the position of the head unit 20U can be set automatically. The position of the head unit 20U can be readjusted by the position adjusting member 58. Further, since the screw is externally inserted through the small hole HL of the housing 1, the width of the ink-jet printer is prevented from increasing, while the size, weight and cost of the printer can be reduced. Further, only one side of the ink-jet printer is used as an external workspace, the positional adjusting operation can be performed more easily and quickly without restriction on space, as compared to the case where both sides are used.

Like the upper supporting members 54L and 54R, the rise preventing members 52L and 52R are made from plastic material and molded integral with the supporting frames 50L and 50R to prevent the head unit 20U attached to the head supporting mechanism 50 from rising. Therefore, the position of the head unit U can be restricted in the vertical direction H without increasing the cost. Further, since the rise preventing members 52L and 52R have the release pawls 53L and 53R for assisting elastic deformation, the head unit 20U can be detached from the head supporting member more smoothly.

Furthermore, since the lower supporting members 55L and 55R are made of an alloy of aluminum having high heat conductivity, they can hold the head unit 20U with satisfactory strength, maintaining the position of the head unit 20U relative to the rotary drum 10 with high accuracy, and the print head 20 can be cooled quickly. Thus, the function can be improved without increasing the cost.

In the above embodiment, the supporting members 54L, 54R, 55L and 55R are formed to correspond to the engaging members 22L, 22R, 23L and 23R. However, the number of engaging members of the head unit 20U can be changed arbitrarily. The number of supporting members of the head supporting mechanism 50 can also be changed in accordance with the number of engaging members of the head unit 20U.

In the above embodiment, the rotary drum 10 holds the print medium and rotates together with the print medium. However, the invention is also applied to the case where the print medium is held by a medium carrier which laterally moves the print medium relative to the head unit 20U.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printer comprising:

a medium carrier which carries a print medium;

a head unit which has a plurality of ink-jet nozzles arranged in a width direction of said medium carrier, and ejects ink toward the print medium carried by said medium carrier from said ink-jet nozzles to print an image on the print medium; and a head supporting mechanism which supports said head unit detachably attached thereto;

wherein said head supporting mechanism includes:

first and second supporting frames facing each other in the width direction of said medium carrier;

first and second supporting sections which are respectively protruded from said first and second supporting frames to receive first and second ends of said head unit put thereon, and support said head unit so as to be slidable in the width direction of said medium carrier;

an urging member which urges the first end of said head unit received by said first supporting section toward said second supporting frame; and a position adjusting member which slides the second end of said head unit put on said second supporting section toward said first supporting frame against an urging force from said urging member;

wherein said position adjusting member includes a screw inserted in a screw hole formed through said first supporting frame and said first supporting section.

2. An ink-jet printer according to claim 1, wherein said medium carrier, said head unit and said head supporting mechanism are received in a housing having a hole through which said screw is externally inserted into said screw hole.

3. An ink-jet printer comprising:

a medium carrier which carries a print medium;

a head unit which has a plurality of ink-jet nozzles arranged in a width direction of said medium carrier, and ejects ink toward the print medium carried by said medium carrier from said ink-jet nozzles to print an image on the print medium; and a head supporting mechanism which supports said head unit detachably attached thereto;

wherein said head supporting mechanism includes:

first and second supporting frames facing each other in the width direction of said medium carrier;

first and second supporting sections which are respectively protruded from said first and said second supporting frames to receive first and second ends of said head unit put thereon, and support said head unit so as to be slidable in the width direction of said medium carrier; and an urging member which urges the first end of said head unit received by said first supporting section toward said second supporting frame;

wherein said head unit includes first and second engaging members projected from lower portions of the first and second ends, and said first and said second supporting sections include first and second receiving members for receiving said first and second engaging members.

4. An ink-jet printer according to claim 3, wherein said head unit further includes third and fourth engaging members projected from upper portions of the first and second ends and laterally displaced with respect to said first and second engaging members, and said first and second supporting members further include third and fourth supporting members for receiving said third and fourth engaging members.

5. An ink-jet printer according to claim 4, wherein said head supporting mechanism further includes a rise preventing member which prevents rise of said third and fourth engaging members received in said third and fourth supporting members.

6. An ink-jet printer according to claim 5, wherein said rise preventing member includes first and second engaging levers which are integrally formed with said first and second supporting frames, elastically deformed for causing said third and fourth engaging members to pass therethrough, and elastically restored for engaging with said third and fourth engaging members on said third and fourth supporting members after passing therethrough.

7. An ink-jet printer according to claim 4, wherein said first and second supporting members are made of a heat conductive metallic material, and said third and fourth supporting members are made of a plastic material together with said first and second supporting frames.

* * * * *